United States Patent [19]

Pressman

[11] 4,082,448

[45] * Apr. 4, 1978

[54] ELECTROSTATIC MODULATOR FOR CONTROL OF FLOW OF CHARGED PARTICLES

[75] Inventor: Gerald L. Pressman, Cupertino, Calif.

[73] Assignee: ElectroPrint, Cupertino, Calif.

[ * ] Notice: The portion of the term of this patent subsequent to Sep. 26, 1989, has been disclaimed.

[21] Appl. No.: 527,101

[22] Filed: Nov. 25, 1974

Related U.S. Application Data

[60] Continuation-in-part of Ser. No. 291,487, Sep. 22, 1972, Pat. No. 3,850,628, which is a division of Ser. No. 85,070, Oct. 29, 1970, Pat. No. 3,694,200.

[51] Int. Cl.[2] ..... G03G 15/052

[52] U.S. Cl. ..... 355/3 SC

[58] Field of Search ..... 355/3 SC, 16; 96/1 R, 96/1.5

[56] References Cited

U.S. PATENT DOCUMENTS

| | | | |
|---|---|---|---|
| 3,680,954 | 8/1972 | Frank | 355/3 SC |
| 3,694,200 | 9/1972 | Pressman | 355/3 SC |
| 3,796,490 | 3/1974 | Pressman | 355/3 SC |
| 3,898,085 | 8/1975 | Suzuki | 96/1.5 |

*Primary Examiner*—L. T. Hix

*Assistant Examiner*—M. L. Gellner

[57] ABSTRACT

A system for controlling the flow of charged particles and for modulated aperture electrostatic printing. An apertured screen having substantially the entire surfaces formed of a dielectric material is charged with like charges over substantially all of its surfaces to develop fringing fields in the apertures. The charge distributed across one side of the screen is selectively dissipated in accordance with the pattern to be reproduced, thereby modifying the fringing fields to form an electrostatic latent image for controlling a flow of charged particles directed to the screen. The screen is initially pre-image charged to carry a higher potential $V_A$ on one face than on the other $V_B$ to provide a potential difference $V_A - V_B$ through the screen apertures. This is accomplished by constructing the screen to have a lower insulator capacitance on side A than on side B; or, to have a greater insulator resistance on side A than on side B; or by selecting the insulator material on side B to have a non-linear resistance characteristic at all voltage levels above the desired value for $V_B$; or, to have combinations of two or more of such characteristics. The pre-image charge is modified in accordance with an image to be reproduced, and, in some regions of the screen $V_A$ is reduced to less than $V_B$. Full modulation control of particle flow is thereby possible with a single selective charge dissipation.

24 Claims, 19 Drawing Figures

ELECTROSTATIC MODULATOR FOR CONTROL OF FLOW OF CHARGED PARTICLES

This is a continuation in part of Ser. No. 291,487, filed Sept. 22, 1972, now U.S. Pat. No. 3,850,628, which is a division of Ser. No. 85,070, filed Oct. 29, 1970, now U.S. Pat. No. 3,694,200.

This invention relates to a new and improved system for modulated aperture electrostatic printing and more generally to an electrostatic modulator for controlling the flow of charged particles and to a method of forming an electrostatic latent image on a coated electrostatic modulator.

BACKGROUND OF THE INVENTION

In conventional xerography, a xerographic plate formed of a layer of photoconductive insulating material coated on a conductive surface is used for establishing and supporting electrostatic latent images. The xerographic plate is electrostatically charged uniformly over its surface and a light pattern corresponding to the image to be reporduced is projected on the plate to selectively dissipate the charge. The resultant latent electrostatic image is developed by powdering with toner particles which are electrostatically attracted to the xerographic plate in a pattern defined by the charge distribution of the electrostatic image. The powder image is thereafter contact transferred to a sheet of paper or other print-receiving medium. Because of interfering electrostatic lines of force established in the latent image, the field lines of force concentrate at the edges of the latent image resulting in reproductions having hollow centers and emphasized edges.

These problems are overcome in the apparatus and method described in the McFarlane U.S. Pat. Nos. 3,339,469 and 3,220,833 wherein the electrostatic latent image is first formed on a screen or interrupted grid of conductive material coated with an insulative photoconductive material. Developing ink toner may be, in one embodiment, clouded onto the electrostatic latent image by filtering the toner particles through the screen or grid mesh onto the charged boundaries of the interstices of the screen in accordance with the charge pattern. The developed toner image is thereafter transferred by projection of the particles along the lines of an overall applied electrostatic force field across a space to a print-receiving medium or other transfer medium. The expedience of noncontact printing, and fine control over the electrostatic latent image charge distribution provided by the interrupted surface of the screen which supports the image, overcome many of the problems of conventional xerography.

Improvements on the McFarlane system are described in the Pressman patent application Ser. No. 673,499 and the Pressman and Kittredge patent application Ser. No. 776,146.

According to these disclosures, there is provided in a preferred embodiment a multi-layered apertured screen including at least a conductive layer and an adjacent insulative layer on which an electrostatic latent image is formed for modulating the flow of charged toner particles or other printing particles directed through the apertures of the screen by an accelerating field. A two-layer screen construction permits the establishing of charge layers on opposed sides of an insulator ("double layer charge") for selectively producing overlapping lines of force or "fringing" fields within the apertures of the screen. The fringing fields extend into and are substantially confined to the apertures, since they are short range and extend no more than a few aperture diameters at full strength. Thus, lines of force generated by fringing fields extend within apertures of the screen and can be oriented to oppose the passage of charged particles, enhance the flow of charged particles, or be neutralized to have no effect on charged particles directed through the screen. Thus, the double layer charge can be selectively established across the fact of the screen to substantially completely block the passage of charged particles through certain apertures, enhance and accelerate the passage of charged particles through other apertures, and control the width and density of the particle stream through other apertures along a continuous range in between. A stream or flow of charged particles directed through the screen by an accelerating field is therefore modulated to provide a cross-sectional density variation at least substantially corresponding with the image to be reproduced. The modulated stream of toner particles or other charged particles is transferred by the overall applied electrostatic projection field across a gap to a print-receiving medium and the powder image is thereafter fixed according to known techniques.

In one approach for establishing the double charge layer electrostatic latent image across the screen, a substantially uniform charge distribution ("pre-image charge") may be initially established across both sides of the insulative layer, with opposite charges on the respective sides, to provide a substantially uniform array of fringing fields within the apertures. These fringing fields include blocking fields to block or partially block particles of a predetermined polarity. By use of photosensitive materials the charge distribution, and therefore the blocking fields, are "imagewise modified" or "imaged" i.e. selectively dissipated according to a light pattern projected on the screen which corresponds to the image to be reproduced. The fringing fields also may include enhancing fields which are established by additional techniques. The screen must generally be charged initially with blocking fields which block the passage of charged toner particles through the screen. The blocking fields are thereafter selectively neutralized according to the light pattern or reversed to enhancing fields according to additional procedures, and the resulting modulation of the flow of charged particles through the screen results in negative printing. In order to achieve positive printing, special contact charging techniques and other expedients are used.

SUMMARY OF THE INVENTION

The present invention provides method and apparatus whereby the screen or modulator is first pre-image charged so that it acquires an initial uniform (from aperture to aperture) array of fringing fields. The screen is thereafter imaged to imagewise modify the uniform array of fringing fields, thereby selectively neutralizing and even reversing the fringing fields to provide an imagewise array of enhancing, blocking and neutral fringing fields on the screen (hereinafter sometimes referred to as a "bipolar electrostatic latent image"). The imagewise fringing field array on the screen is thereafter employed in printing by known techniques, such as, for example, by directing a stream of charged toner particles through the screen onto a print receiving medium, or by directing a stream of ions through the screen onto dielectric paper to form a charge image for subsequent toner development.

The screen or modulator of the present invention comprises a conductive apertured grid substantially completely covered on all surfaces with insulative dielectric material.

The initial (pre-image) uniform array of fringing fields is imposed on the screen by applying electrical charge (for example, from a corona ion source) of a single polarity to opposed faces of the screen. According to the present invention, the potentials acquired by opposed faces of the screen during pre-image charging are separately controllable so that, when pre-image charging is concluded, the potential of the charge layer on one face of the screen is greater than the potential of the charge layer on the opposed face of the screen. As a result, a voltage drop or potential difference exists between the screen faces which, in turn, results in the pre-image array of fringing, fields referred to above.

For convenience, the side of the screen which acquires the greater potential during pre-image charging will be referred to herein as "side A" and the opposite side of the screen will be referred to as "side B", whereas the potentials acquired by those sides will be referred to as $V_A$ and $V_B$, respectively.

It is an objective of the present invention that, upon completion of pre-image charging, $V_A > V_B$. A feature of the present invention is that the screen is constructed in such a manner that attainment of the pre-image condition $V_A > V_B$ is a natural incident of exposing sides A and B, or side A alone, to corona discharge or other charging.

The present invention is characterized in that it improves, by shortening, the charging time required for establishing an initial pre-image charge on the screen. The invention also readily enables the direct establishment of the imagewise charge pattern on the modulator, particularly for positive type printing.

It is therefore an object of the present invention to provide an improved modulated aperture electrostatic non-contact printing system which permits direct positive printing with an electrostatic screen modulator which controls the density flow of charged particles directed through the screen.

Another object of the invention is to provide an electrostatic screen modulator for supporting a double charge layer electrostatic latent image and which can be charged to satisfactorily high voltages at desired levels in relatively short periods of time.

A further object of the invention is to provide an electrostatic screen modulator for supporting a double charge layer electrostatic latent image in which the selective charge distribution can be established by simple light projection techniques to provide both blocking and enhancing fields and fields along a continuous range in between for controlling the flow of charged particles directed through the screen by an accelerating field.

Another object is the provision of the screen modulator capable of producing enhancing through blocking field control from single sign charge while enabling positive or negative printing in electrostatic printing applications.

A still further object is the provision of a unique method for electrostatic latent image modulation control and particularly for control of electrostatic printing processes.

Another feature and advantage of the embodiment of the present invention in which the conductive screen surfaces are entirely coated with insulative material so that no conductive surfaces are exposed is that a high voltage charge can be established on the screen in a short period of time using, for example, corona charging currents.

Other objects, features and advantages of the present invention will become apparent in the following specification and accompanying drawings.

PREFERRED EMBODIMENTS

Figure 1A:
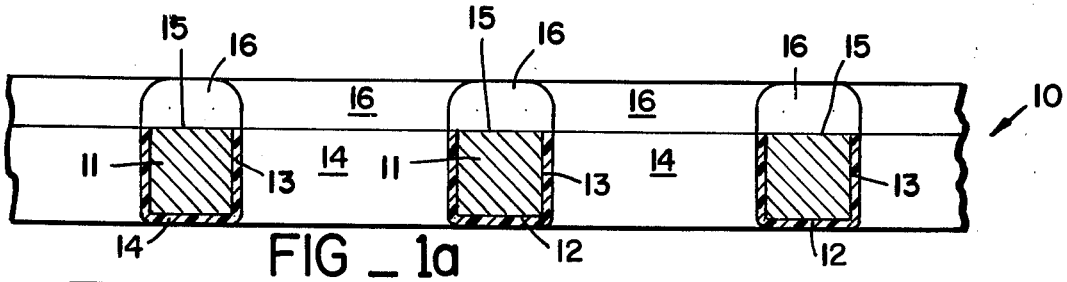
FIGS. 1*a* through 1*e* are end cross-sectional views of an electrostatic screen modulator according to the present invention.
Figure 1B:
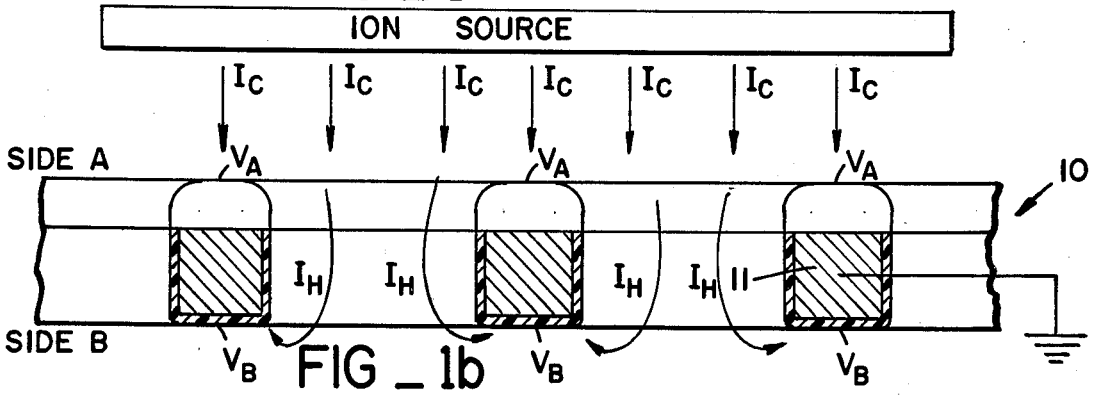
Figure 1C:
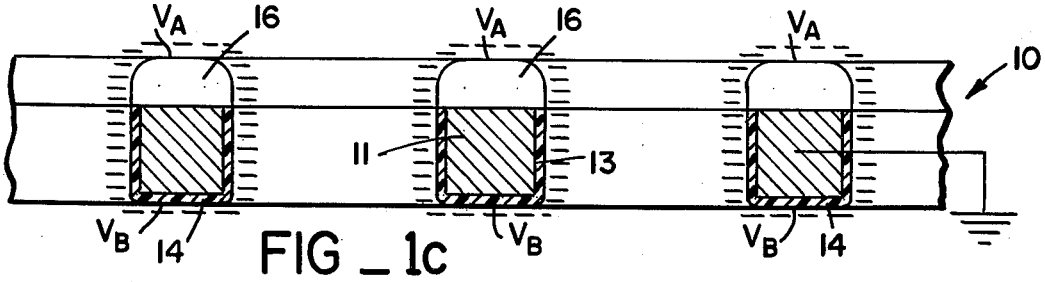
Figure 1D:
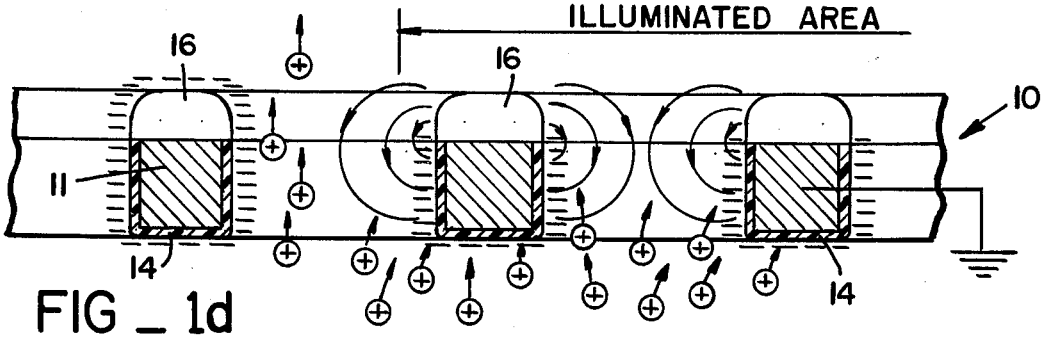
Figure 1E:
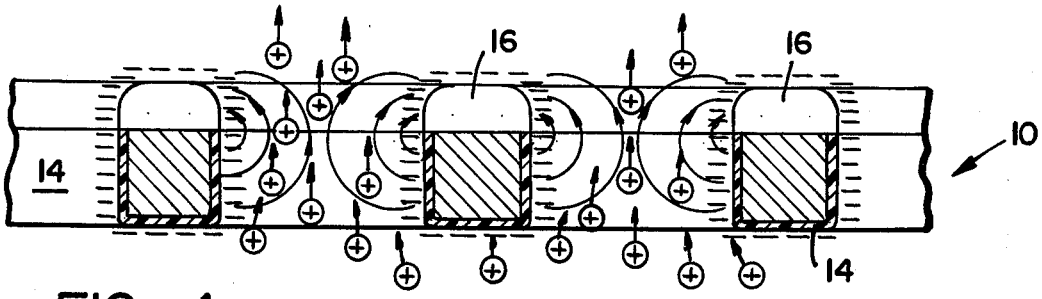

In FIGS. 1 through 1*e*, an electrostatic screen modulator 10 is constructed with a screen or mesh base 11 of metal or other conductive material. The metal screen base 11 is coated on one surface 12 of the screen and on the inside walls 13 of the screen apertures with a layer 14 of ordinary electrical insulator material, preferably having a high dielectric strength as well as high resistivity. The opposite surface 15 of the metal screen base 11 is coated with a layer 16 of a photoconductive insulating material.

In forming the screen, the metal screen base 11 is first coated with the layer 14 of insulator material along one surface 12 of the screen and on the inside walls 13 defining the apertures or holes through the screen. The insulator material can be applied, for example, by spraying the screen from one side. This may result in some deposition of the insulator material 14 on the opposite surface 15 of the screen. Such material can be removed by rubbing the surface 15 with abrasive material after the screen has been sprayed from one side. The photoconducting insulative material is then applied to the uncoated surface 15 of the screen. The photoconductor material is preferably applied so that coating of the internal walls of the screen holes is avoided, but a small degree of internal coating (not shown) can be tolerated. Such selective coating of the surface 15 of the screen base 11 can be accomplished by electrostatic spraying of the photoconductive material after first charging the insulator layer 14 with charges similar to that applied to the photo-conductive material 16. The photoconductor 16 is thereby repelled from the insulator surfaces 14 during deposition so that separation of the coatings 16 and 14 results. The entire surfaces of the metal screen base 11, however, are coated with an insulative layer, either 14 or 16.

A. Pre-Image Screen Charging

It was previously believed that any screen completely covered by an insulator would, when exposed on one side to charging current, acquire or at least tend to acquire the same potentials on both faces i.e. $V_A = V_B$.

This can be better understood with reference to FIG. 1*b* where it will be noted that when the Ion Source is located adjacent side A, side B can only receive corona ion current $I_c$ through the apertures, whereas side A receives charge directly. According to fringing-field theory, current will not flow through the screen apertures unless a potential difference is established between the sides or faces of the screens. Thus, side B receives corona charging current only as long as the potential of side B is less than A, and B will naturally tend to charge up to a potential $V_B$ equal to A's potential $V_A$.

Despite the foregoing natural tendency, I have discovered a manner of screen construction whereby one face of the screen naturally attains a controllably higher potential than the other as a result of customary pre-image charging steps. I accomplish this by selecting the electrical and/or geometric characteristics of the A layer to be different in certain specific respects from the B layer, as follows, separately or in combination:

(i) differential capacitance, (ii) differential resistance, and (iii) non-linear resistance in the B layer at some preselected potential $V_o > V_A$.

The first two characteristics require very thin B layers, relative to the A layer, whereas the last named (non-linear B layer) does not require the B layer to be thinner than the A layer and is preferred. This can be readily understood from the following analysis of the manner in which each of the above three characteristics leads to the desired state, $V_A > V_B$.

1. Differential Capacitance

When the capacitance of B is increased relative to A, A charges at a faster rate than B. In this technique, the charging process is stopped short of the time that the B layer reaches its steady-state condition i.e. the condition where leakage of charge through the insulator layer B equals the incident corona current $I_c$. Capacitance of the B layer ($C_B$) may be increased, either by a decrease in the thickness of layer B, or by an increase in the dielectric constant of the B material. Alternatively, or in combination, the capacitance of layer A ($C_A$) can be made small, implying a relatively thick insulator layer and/or a relatively low dielectric constant for the A side. Actual voltage differences achieved will be very sensitive to total corona current and exact corona charging time. Extreme differences in charging time constants would be necessary to avoid this sensitivity (for example, a $V_A$ time constant of about .01 second and $V_B$ of about 1 second). Since the range of dielectric constants available in coating materials is limited, very thin B layers are required. This requirement is more severe if the A surface is a commonly used photoconductor material such as CdS binder systems or amorphous selemium, since these materials have relatively high dielectric constants (about 10-15) and cannot be made very thick without disturbing their photoconductive properties, in which case decreasing $C_A$ is not generally an available control.

2. Differential Resistance

Figure 2:
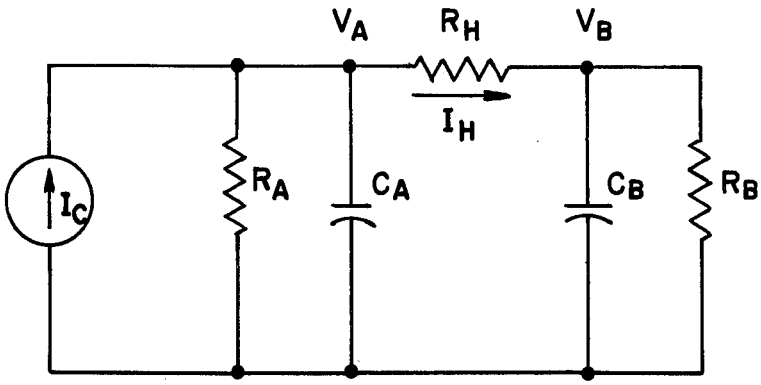
FIG. 2 is an electrical circuit diagram equivalent, to the pre-image charging system shown in FIG. 1*b*.
Figure 2A:
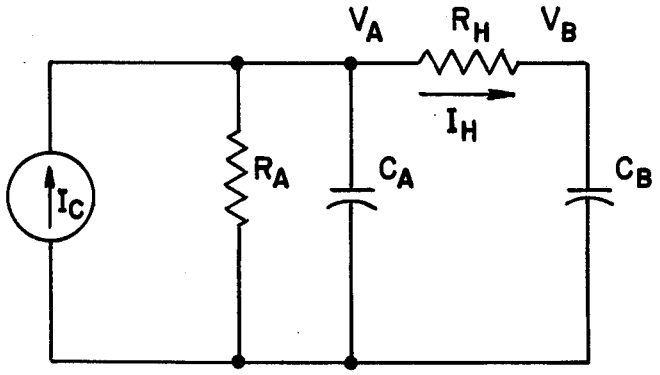
FIG. 2*a* is a modified equivalent circuit diagram for FIG. 1*b* where layer B is assumed to be a perfect insulator.

The differential resistance technique is best described by reference to an equivalent circuit illustrated in FIG. 2 herein. From this circuit, it will be noted that if layer B is a perfect insulator ($R_B = \infty$) then the circuit becomes as shown in FIG. 2*a* and a simple analysis shows that in the steady state $V_A = V_B = I_C R_A$. This is the condition described above in which both the A and B layers tend to charge to the same potential without regard to the properties of the layers A or B. In experimentation, the first materials selected for the B layer were, quite naturally, good insulators so that the A and B layers tended to charge to roughly the same potential.

It will be noted that the differential capacitance technique described above can be employed even where the B layer is a good insulator. However, referring to FIG. 2 which includes the resistance (leakage) of the B layer, it is apparent that even in the steady state a potential difference can be achieved by controlling $R_B$ and $R_A$, since $$V_A - V_B = \frac{R_A R_H I_C}{R_A + R_H + R_B} \tag{1}$$

Thus, either increasing $R_A$ or decreasing $R_B$ can provide higher values of $V_A - V_B$. $V_A - V_B$ is always a positive quantity; therefore, a potential difference of some magnitude will exist with $V_A$ greater than $V_B$, unless $R_B$ is infinite as illustrated by FIG. 2*a*.

Equation (1) can also be written:

$$V_A - V_B = \frac{R_H}{R_B + R_H} V_A \tag{2}$$

in which the potential difference is given as a fraction of the A layer potential. Thus, if a certain potential $V_A$ is required to effect electrostatic control of charged particles in the aperture, then the only real control over $V_A - V_B$ is through $R_B$ and $R_H$. $R_H$ is a function of screen geometry which is not readily adjustable; however, $R_H$ depends upon $I_C$. $R_H$ is not a "real" resistance; it merely expresses the ratio of screen potential difference to current flow through the screen, and the current through the screen also depends upon $I_C$. $R_B$ is determined by (i) the resistivity of the material used for layer B, and (ii) the thickness of layer B.

The most direct approach would be to employ a material of selected resistivity to form the B layer. Since photoconductivity is not required in the B layer, a wide selection of materials of varying resistivities is available. There is, however, another limitation in that it is necessary for the B layer to support its surface potential during the subsequent steps of the process. If the resistivity of the B layer material is too low, the ability of the B layer to support its potential after completion of the charging step is impaired. Charge carrying ability of the layer is independent of the layer thickness. The decay rate of charge is given by the formula $$V = V_B e^{\frac{-t}{\tau_B}} \tag{3}$$

where $\tau_B$ is the "relazation time" the material used and is given by $$\tau_B = \rho_B \kappa_B \epsilon_0 \tag{4}$$

where $\rho_B$ is the volume resistivity and $\kappa_B$ the dielectric constant ($\epsilon_0$ = permittivity of free space). $\tau_B$ should be as long as possible, generally longer than 30 seconds. Since $\epsilon_0 = 8.9 \times 10^{-14}$ fd/dm and $\kappa_B$ is usually 10 or less, if $\tau_B$ to be 30 seconds, then $$\rho_B \geqq 3 \times 10^{13} \text{ ohm cm} \tag{5}$$

which is in the range of good insulators. The resistance of layer B, however, is given by $$R_B = \frac{\rho_B t_B}{S} \quad (6)$$

where $t_B$ = layer thickness and S is the surface area of the layer. Thus, for any value of $\rho_B$, $R_B$ can be completely controlled by controlling the thickness of the B layer, $t_B$. As layer B is made thinner, the value of $R_B$ becomes smaller and, thereby, the value for the potential difference $V_A - V_B$ is increased. For an insulator having a resistivity of $\rho_B = 10^{13}$ ohm cm, very thin B layers must be employed. $R_H$ can be made to about $10^8$ ohm for $S = 1$ cm$^2$. $V_A - V_B \simeq \frac{1}{2} V_A$, then from Equation (2), $R_B - R_H = 10^8$ ohm. If $\rho_B = 10^{13}$ ohm-cm, Equation (6) gives $$t_B = S\frac{R_B}{\rho_B} = 10^{-5} \text{ cm or } 0.1 \text{ micron} \quad (7)$$

3. Non-Linear B-Layer Resistance

The need for exceptionally thin B layers can be alleviated by selecting a material for the B layer which has a resistance characteristic which becomes non-linear at some potential $V_o$. When the coated screen is subjected to corona charging current, as potential on the coating builds up, leakage current through the insulator increases until the leakage current equals the incident corona current. When this occurs, no further voltage increase is obtained on the surface. This leakage increase may be proportional to voltage, in which case it is referred to as "linear", or, at values above a certain voltage, the leakage increase may be even greater than linear, referred to hereinafter as "non-linear". When the leakage-voltage characteristic is highly non-linear, the term "breakdown" is often used to describe the voltage limiting effect. Thus, if the screen is constructed of two materials, each with different voltage leakage characteristics, a controlled potential difference can be obtained. When a B layer material has been selected which becomes non-linear at some pre-determined $V_o$, for example, the resistivity of the B layer $\rho_B$ has a high value for $V_B < V_o$, but rapidly decreases for $V_B > V_o$, the steady state charging point would stabilize at some high voltage $V_B > V_o$ where $\rho_B$ is low enough to meet the condition of Equation (6) a reasonable thickness $t_B$. Of course, as soon as charging stops, rapid relaxation of layer B takes place as given by Equation (4), but as soon as $V_B$ drops below $V_o$, $\rho_B$ rapidly increases, stopping the relaxation decay. In this instance, the only limitation on $t_B$ is that $V_o$ occur at the desired value, since the ultimate potential difference will be $V_A - V_o$. By proper composition of the material layer for layer B, relatively thick layers may be employed. By utilization of the non-linear resistivity effect, it will be noted that it is not necessary that layer B be thinner than layer A.

B. Imaging The Screen

After the screen has undergone pre-image screen charging, side A is imaged, whereby $V_A$ is selectively modified in accordance with an image or pattern to be reproduced. Thus $V_A$ ceases to have a fixed value and becomes a function of the image. For example, where side A is optically imaged, the new value $V_A(x)$ of $V_A$ at any point in the image is directly proportional to the amount of illumination ($x$) impinging at that point. Thus, $V_A(x)$ may have a range of values $V_A(1)$, $V_A(2)$ . . . $V_A(n)$ throughout the image, and that range may extend from $V_A$ down to ground potential or zero, and may be expressed $V_A \leqq V_A(x) \leqq 0$. On the other hand, $V_B$ is not image-wise modified and remains constant, except that both $V_A(x)$ and $V_B$ decay somewhat due to normal charge leakage through insulators A and B, respectively.

FIG. 1c represents an insulator coated screen which has been pre-image charged with negative ions, represented by dashes on the surfaces of the photoconductor 16 and insulator 14. It will be assumed that pre-image charging has been carried out in accordance with the principles of the present invention, as described above, and therefore that $V_A > V_B$.

FIG. 1d depicts a section of an imaged screen where a relatively light portion of the image has been projected on the right side of the screen, as indicated by the label "Highly Illuminated Area". The conductive core 11 is held at a fixed potential (ground). In this relatively light area, the photoconductor layer 16 has become relatively conductive and the negative charge has been conducted away to ground whereby $V_A(x) > V_B$. Thus, the potential difference $V_B - V_A(x)$ generates fringing fields in the apertures which tend to block passage of positively charged particles through the apertures in the B to A direction, as shown. The left side of the screen is in a relatively darker portion of the image and will have a reduced ability to block. If $V_A(x)$ is reduced to a value equal to $V_B$, then the screen is neutral to passage of charged particles.

FIG. 1e illustrates a region of the screen which experienced little or no illumination during imaging so that $V_A(x) > V_B$, whereby $V_A(x) - V_B$ provides fringing fields in the apertures which serve as enhancing fields to the flow of positively charged particles in the B to A direction, as indicated by the curved lines of electrical fringing force extending from the insulator layers into the apertures.

It will be appreciated that if the flow of charged particles to be imagewise modulated by the imaged screen were reversed in both polarity (negatively charged particles) and direction (A to B), the net effect of the imaged screen upon the charged particles would be to pass particles in the dark areas and block in the light areas. Thus, in both cases, positive to positive (or negative to negative) printing would be carried out, whereas, if only the polarity or direction were changed, then negative to positive (or pos. to neg.) printing would result. Similarly, it will be readily appreciated that the pre-image charging of the screen could be accomplished with positive charge, whereupon the screen would modulate a flow of negatively charged particles in the B to A direction for positive to positive (or negative to positive) printing. Negative to positive (or positive to negative) printing could be carried out by making a reversal of direction or polarity in the manner suggested by the previous discussion.

Charging of the surfaces of the modulator screen 10 is accomplished, for example, by corona discharge currents from a corona spray source or corona wand.

The initial flow of charged particles (such as charged toner particles) through the imaged screen is created by an overall applied electrostatic accelerating field in which the modulator screen is interposed to modulate the established flow of charged toner particles.

In the embodiment of the present invention illustrated in FIGS. 1a through 1e, the metal or other conductive screen base is coated over its entire surfaces with insulative material, either ordinary insulating material or photoconductive insulating material. The insulative coatings can be applied to a variety of conductive screens such as, for example, etched metal or woven wire screens, and in a variety of configurations as illustrated in the examples of FIGS. 3*a* through 3*i*.

Figure 3A:
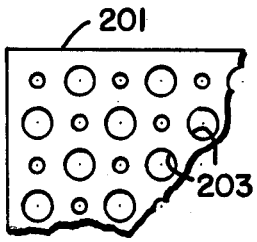
FIGS. 3*a* through 3*i* are fragmentary diagrammatic views of various screen configurations applicable in the present invention.
Figure 3B:
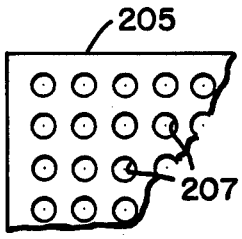
Figure 3C:
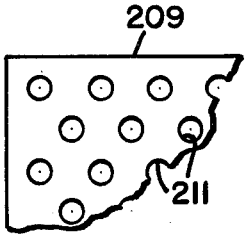
Figure 3D:
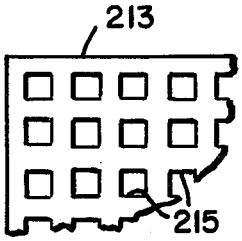
Figure 3E:
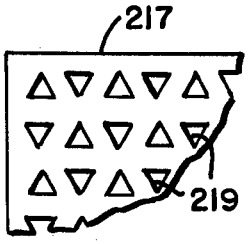
Figure 3F:
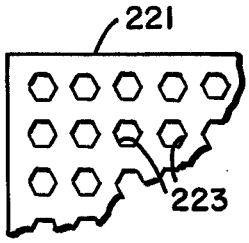
Figure 3G:
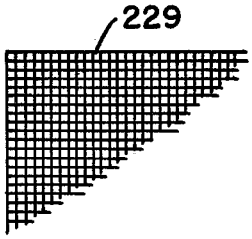
Figure 3H:
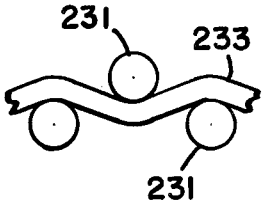

It should be noted that the screens described herein are not limited to any given shape, size, or distribution of apertures and may even contain apertures of varying size and/or shape and/or distribution even in a random fashion as shown in FIGS. 3*a* through 3*i*. In Screen 201 (FIG. 3*a*), apertures 203 are distributed in a random fashion and may have randomly distributed size and irregular shape as well. The screen 205 (FIG. 3*b*) consists of the uniform array of circular apertures 207 in essentially a square or 90° pattern. Alternately, the apertures 211 as shown in screen 209 (FIG. 3*c*) may be circular, arrayed in a uniform pattern of a triangular or 60 degree distribution. In screen 213 (FIG. 3*d*) the apertures 215 are square and arrayed in a square or 90° pattern, in screen 217 (FIG. 3*e*), the apertures consist of triangular holes 219 arrayed in alternating pattern, and in screen 221 (FIG. 3*f*), the apertures consist of hexagonal holes 223 arranged in a square pattern. It is also possible as indicated in screen 229 (FIG. 3*g*) that the screen be composed of a distribution of wires which may be woven into a mesh as indicated in FIG. 3*h* in which wires 231 and 233 are interwoven to provide a woven wire screen.

Figure 3I:
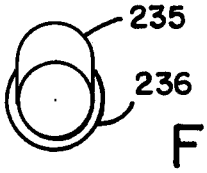

In the event of a woven wire screen comprised of wire of circular cross section, the coating of the entire surfaces of the screen may be accomplished in the manner indicated in FIG. 3*i*. Thus, the ordinary insulative material is coated in a layer 236 around a major portion of the circumference of the wire so that it covers the portions comprising one surface of the screen and the walls defining the aperture holes through the screen. The photoconductive material is coated in a layer 235 around a minor portion of the circumference of the screen covering the portions comprising the opposite surface of the screen. As explained hereinafter, a significant improvement in the capability of the screen in acquiring and retaining charge results because all of the metal or conductive portions are covered with insulative material. In the various configurations shown in FIGS. 3*a* through 3*f* the coating of the etched screens can be improved if the corners of the screen are abraded or otherwise rounded before coating.

Figure 4A:
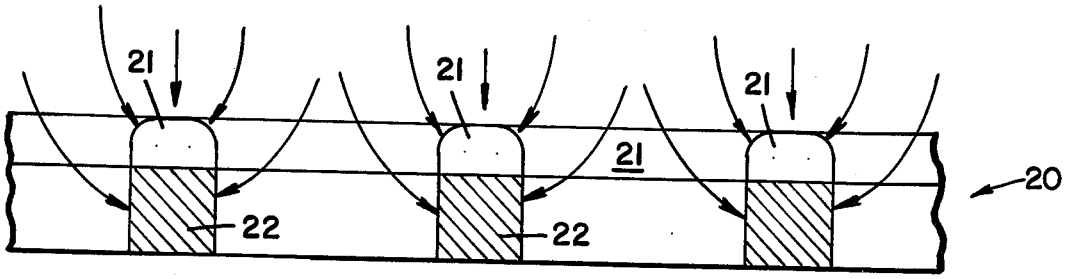
FIGS. 4*a* and 4*b* are end cross-sectional views of a prior art electrostatic screen modulator consisting of a conductive layer and an insulative layer.
Figure 4B:
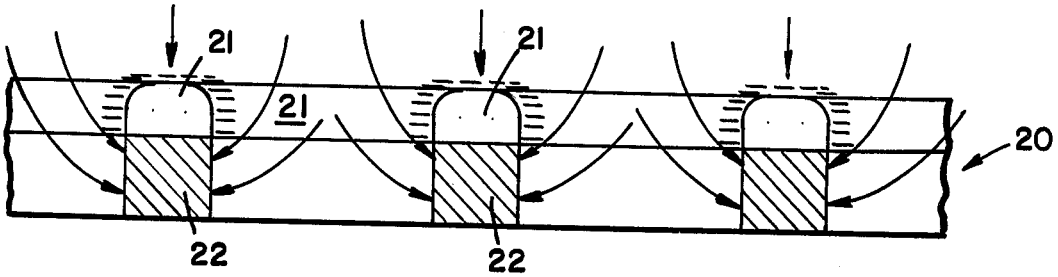

An advantage of the construction of the present invention in addition to the direct positive imaging which it provides resides in the greater charge acceptance capability by the conductive screen base having its surfaces substantially completely coated with insulative material. In the prior art, by using square edges, electrostatic screen modulator 20 consisting of an insulative layer 21 and an adjacent conductive layer 22, as illustrated in FIGS. 4*a* and 4*b*, it has been found that the potentials acquired by the photoconductive material 21 are lower than the potentials acquired by the same material coated to the same thickness on a flat metal plate or plane. For example, a 1.0 mil thick coating of photoconducting insulative material which charges to −600 volts on a flat metal plate may only acquire −150 volts on an apertured screen of the type illustrated in FIGS. 4*a* and 4*b* under identical charging conditions. The reason for this difference is that the exposed metal areas of the conductive layer 22 inside the aperture holes of the screen provide a current path which reduces the corona current flow to the photoconductor layer 21. Although the corona charging current flows to all surfaces of the screen initially, a small amount of charge build-up on the photoconductor layer 21 diverts a substantial portion of the corona current flow into the apertures and to the conductive layer as shown in FIG. 4*b*, whence it is conducted to ground or other fixed potential at which the conductive layer 22 is maintained. The inflow of corona charging current and the out flow of current through the conductive layer 22 eventually stabilizes at a point where the leakage in the photoconductor balances the corona current flow to the photoconductive surface and no further increase in potential is possible. In the electrostatic modulator screen configurations of FIGS. 1*a* through 1*e*, however, there is no exposed conductive layer or metal layer to provide a bypass for the corona current flow and the charge quantity and potential acquired by the photoconductive insulator and ordinary insulator layers approaches that of an insulative layer on a flat plate. Because none of the corona current flow is bypassed to ground or other fixed potential, the corona current requirements are greatly reduced and the time required to charge the screen is also reduced.

Figure 5:
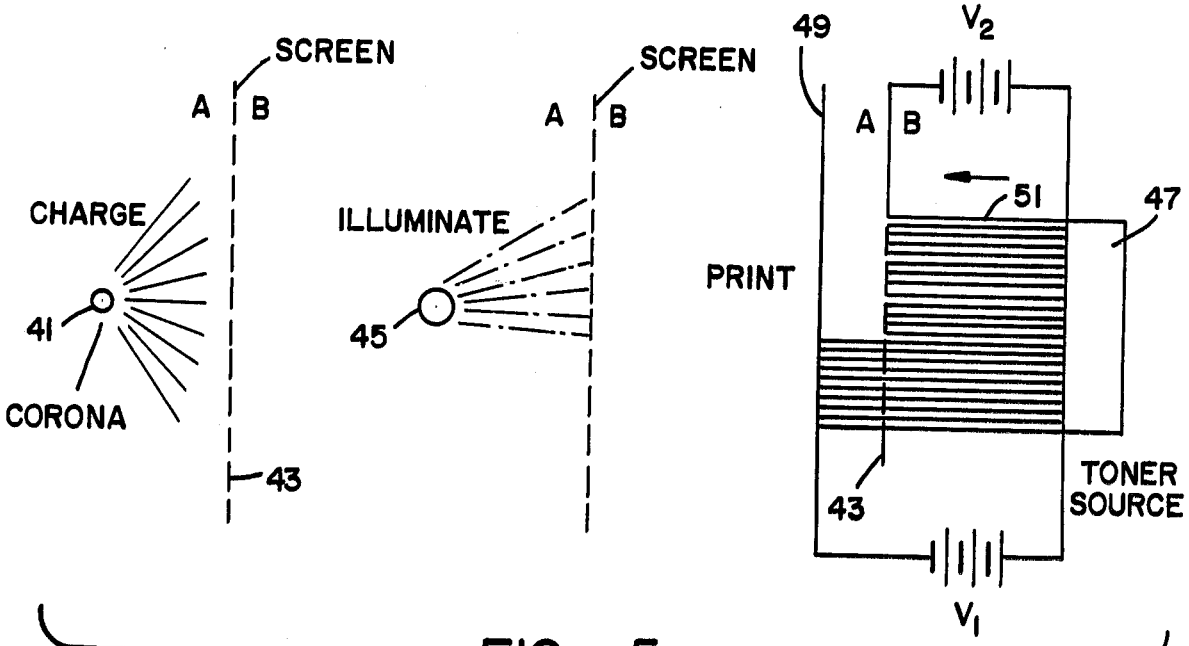
FIG. 5 is a diagrammatic view of an electrostatic printing system.

A positive to positive electrostatic printing system according to the present invention is shown diagrammatically in FIG. 5. An electrostatic screen modulator 43 of the type, for example, illustrated in FIGS. 1*a* through 1*e* is initially subjected to pre-image charging by means of, for example, corona wand 41 so that a like charge is established over substantially all of the surfaces of screen 43, as heretofore described in connection with FIGS. 1*b* and 1*c* so that a greater potential is accumulated on the photoconductive side of the screen to establish a uniform array of enhancing fringing fields of force within the screen apertures. The screen 43 is thereafter illuminated by a source 45 which displays on the surface of the screen coated with photoconductive insulating material a light pattern corresponding to an image to be reproduced. The metallic or other conductive screen core is grounded or maintained at a fixed potential to selectively dissipate the charge deposited on the photoconductive layer in proportion to the intensity of light projected on different portions of the screen. A bipolar electrostatic latent image is thereby established on the screen 43 which is then interposed between a toner source 47 and a back electrode and printreceiving medium 49. The toner source 47 is maintained at a fixed potential for charging the toner particles and an overall accelerating or propulsion field is established between the toner source 47 and back electrode and print-receiving medium 49. The polarities are arranged so that charged toner particles from source 47 are accelerated toward the electrode 49 creating a flow of charged toner particles. The flow of particles is intercepted and modulated by imaged screen 43 interposed in the toner flow path in the manner previously described in connection with FIGS. 1*d* and 1*e*.

The electrostatic screen modulator of the present invention is applicable not only for controlling the flow of charged toner particles or droplets or other printing material, but also for controlling the flow of charged particles generally. For example, the modulator can be utilized for controlling a flow of ions as set forth in U.S. Pat. No. 3,645,614 entitled "APERTURE-CONTROLLED ELECTROSTATIC PRINTING SYS-

TEM AND METHOD EMPLOYING ION PROJECTION".

The electrostatic screen modulator of the type illustrated herein is also suitable for use if the form of an endless belt or web, as shown in FIG. 8 of U.S. Pat. No. 3,694,200. FIG. 8 of U.S. Pat. No. 3,694,200, together with the description appearing at line 67, col. 9 through line 21, col. 11, and lines 35–38, col. 11, thereof are hereby expressly incorporated herein by this reference, except it will be appreciated that in utilizing the system of FIG. 8 in accordance with the principles of the present invention, the outward facing photoconductor material on the web is raised to a greater potential then the ordinary insulator on the inner web surface during preimage charging.

It can be appreciated that the present invention is characterized by an electrostatic modulating screen of sufficient thickness compared to the hole or aperture diameter to permit development of blocking or repulsing fields of force within the holes or apertures which can overcome the overall projection field established between the toner supply and back electrode. Electrostatic charge levels for the screen and accelerating fields must therefore be selected accordingly. Furthermore, fringing fields of polarity and strength over a continuous range from enhancing to blocking can be established within the apertures of the modulating screen to permit continuous tone gray-scale and color printing.

It has been found that the preferred gap for transferring charged toner or other marking material or droplets between the electrostatic flow modulating screen and the printreceiving paper is in the order of 1/16 to ¼ of an inch but it is to be noted that contact printing can also be achieved with the process of the present invention. Toner particles as large as 20 microns have been found to be operative in a system of the present invention and to provide good quality printing. Even smaller sizes, however, are, of course, preferred. Dielectric materials for the screen can be selected from any of a number of suitable dielectrics, such as plastic, quartz, and many others.

In addition, FIGS. 9 through 12 of U.S. Pat. No. 3,694,200 and related portions of the description, including line 51, col. 11 through line 70, col. 12, are expressly incorporated herein by this reference; however, it should be further pointed out in connection with the discussion appearing at lines 61–70, col. 12, that a further screen parameter is that the ratio of screen thickness (measured from face A to face B) to aperture diameter should be no greater than about 1.0 for the establishment of fringing fields in the apertures.

What is claimed is:

1. An electrostatic modulator for controlling the flow of charged particles comprising:

An apertured screen comprising an equipotential conductive core and a coating of electrically insulative material covering said equipotential conductive core and forming substantially the entire surfaces of the screen and the inner surfaces of the aperture, that portion of the coating covering the first face of the screen having different geometric properties than the portion of the coating covering the second face of the screen so that when said first and second faces of said screens are simultaneously charged for a preselected period of time, the first face of the screen retains a different potential following completion of charging than the second face of the screen; means for simultaneously charging the coating over both faces of the screen with like charges for said preselected period of time; and means for selectively dissipating the charge across one face of the screen in accordance with a pattern to be reproduced, thereby establishing an electrostatic latent image corresponding to the pattern to be reproduced.

2. An electrostatic modulator as set forth in claim 1 wherein the coating on the first face of the screen is of photoconductive material.

3. An electrostatic modulator as set forth in claim 2 wherein said photoconductive coating is characterized by the ability to retain a greater potential following completion of charging than the coating on the opposed face of said screen.

4. An electrostatic modulator as set forth in claim 2 further comprising means for projecting a light pattern in accordance with the pattern to be reproduced onto said photoconductive coating; and a means for maintaining the conductive core at a fixed electrical potential.

5. An electrostatic modulator as set forth in claim 1 wherein the coating on one face of said screen has a lower insulator capacitance than the opposed coating.

6. An electrostatic modulator as set forth in claim 1 wherein the said coating on one face of said screen has a greater insulator resistance on one face of said screen than on the opposed face.

7. An electrostatic modulator as set forth in claim 1 wherein said coating on one face of said screen has a non-linear resistance characteristic at all voltage levels above a first predetermined value, where said first predetermined value is different than the predetermined voltage value which the opposed coating is designed to acquire during charging by said charging means.

8. An electrostatic modulator for controlling the flow of charged particles comprising:

An apertured screen comprising an equipotential conductive core and a coating of electrically insulative material covering said equipotential conductive core and forming substantially the entire surfaces of the screen and the inner surfaces of the aperture, that portion of the coating covering the first face of the screen having different electrical properties than the portion of the coating covering the second face of the screen so that when said first and second faces of said screens are simultaneously charged for a preselected period of time, the first face of the screen retains a different potential following completion of charging than the second face of the screen; means for simultaneously charging the coating over both faces of the screen with like charges for said preselected period of time; and means for selectively dissipating the charge across one face of the screen in accordance with a pattern to be reproduced, thereby establishing an electrostatic latent image corresponding to the pattern to be reproduced.

9. An electrostatic modulator as set forth in claim 8 wherein the coating on the first face of the screen is of photoconductive material.

10. An electrostatic modulator as set forth in claim 9 wherein said photoconductive coating is characterized by the ability to retain a greater potential following completion of charging than the coating on the opposed face of said screen.

11. An electrostatic modulator as set forth in claim 9 further comprising means for projecting a light pattern in accordance with the pattern to be reproduced onto said photoconductive coating; and a means for maintaining the conductive core at a fixed electrical potential.

12. An electrostatic modulator as set forth in claim 8 wherein the coating on one face of said screen has a lower insulator capacitance than the opposed coating.

13. An electrostatic modulator as set forth in claim 8 wherein the said coating on one face of said screen has a greater insulator resistance on one face of said screen than on the opposed face.

14. An electrostatic modulator as set forth in claim 8 wherein said coating on one face of said screen has a non-linear resistance characteristic at all voltage levels above a first predetermined value, where said first predetermined value is different than the predetermined voltage value which the opposed coating is designed to acquire during charging by said charging means.

15. An electrostatic modulator for controlling the flow of charged particles comprising:

An apertured screen comprising an equipotential conductive core and a coating of electrically insulative material covering said equipotential conductive core and forming substantially the entire surfaces of the screen and the inner surfaces of the aperture, that portion of the coating covering the first face of the screen having different geometric and electrical properties than the portion of the coating covering the second face of the screen so that when said first and second faces of said screens are simultaneously charged for a preselected period of time, the first face of the screen retains a different potential following completion of charging than the second face of the screen; means for simultaneously charging the coating over both faces of the screen with like charges for said preselected period of time; and means for selectively dissipating the charge across one face of the screen in accordance with a pattern to be reproduced, thereby establishing an electrostatic latent image corresponding to the pattern to be reproduced.

16. An electrostatic modulator as set forth in claim 15 wherein the coating on the first face of the screen is of photoconductive material.

17. An electrostatic modulator as set forth in claim 16 wherein said photoconductive coating is characterized by the ability to retain a greater potential following completion of charging than the coating on the opposed face of said screen.

18. An electrostatic modulator as set forth in claim 16 further comprising means for projecting a light pattern in accordance with the pattern to be reproduced onto said photoconductive coating; and a means for maintaining the conductive core at a fixed electrical potential.

19. An electrostatic modulator as set forth in claim 15 wherein the coating on one face of said screen has a lower insulator capacitance than the opposed coating.

20. An electrostatic modulator as set forth in claim 15 wherein the said coating on one face of said screen has a greater insulator resistance on one face of said screen than on the opposed face.

21. An electrostatic modulator as set forth in claim 15 wherein said coating on one face of said screen has a non-linear resistance characteristic at all voltage levels above a first predetermined value, where said first predetermined value is different than the predetermined voltage value which the opposed coating is designed to acquire during charging by said charging means.

22. An electrostatic modulator for controlling the flow of charged particles comprising:

an apertured screen having first and second opposed faces, said screen including a coating of electrically insulative material forming substantially the entire surfaces of the screen including the inner surfaces of the apertures, that portion of the coating covering the second face of the screen having different electrical properties from the portion of the coating covering the first face of the screen, said portion of said coating covering the second face of said screen having a non-linear resistance characteristic at all voltage levels above a first pre-determined value, where said first predetermined value is less than a second predetermined voltage value which the portion of the coating covering the first face is designed to acquire during charging by charging means;

charging means located adjacent the first face of said screen for charging said faces to said predetermined voltages with charges of like polarity, said second face of the screen acquiring a surface potential smaller than the surface potential of said first face of said screen;

and means for selectively dissipating the charge across said first face of said screen in accordance with the pattern to be reproduced, thereby establishing an electrostatic latent image corresponding to the pattern to be reproduced.

23. The electrostatic modulator of claim 22 wherein said coating on said first face of said screen is of a photoconductive material.

24. An electrostatic modulator as set forth in claim 23 wherein said apertured screen is provided with a conductive core; and means for maintaining said conductive core at a fixed potential.

* * * * *